US010186807B2

(12) United States Patent
Campbell et al.

(10) Patent No.: US 10,186,807 B2
(45) Date of Patent: Jan. 22, 2019

(54) CONNECTOR ASSEMBLY WITH VARIABLE AXIAL ASSIST

(71) Applicant: Delphi Technologies, LLC, Troy, MI (US)

(72) Inventors: Jeffrey Scott Campbell, West Bloomfield, MI (US); Wesley W. Weber, Jr., Metamora, MI (US)

(73) Assignee: Delphi Technologies LLC, Troy, MI (US)

( * ) Notice: Subject to any disclaimer, the term of this patent is extended or adjusted under 35 U.S.C. 154(b) by 0 days.

(21) Appl. No.: 15/867,358

(22) Filed: Jan. 10, 2018

(65) Prior Publication Data

US 2018/0351294 A1 Dec. 6, 2018

Related U.S. Application Data

(63) Continuation-in-part of application No. 15/612,059, filed on Jun. 2, 2017, now Pat. No. 9,917,402.

(51) Int. Cl.
*H01R 13/62* (2006.01)
*H01R 13/629* (2006.01)
*H01R 13/514* (2006.01)

(52) U.S. Cl.
CPC ..... *H01R 13/62944* (2013.01); *H01R 13/514* (2013.01)

(58) Field of Classification Search
CPC ..... H01R 13/62905; H01R 13/62911; H01R 13/62916; H01R 13/62922; H01R 13/62927; H01R 13/62933; H01R 13/62938; H01R 13/62944;
(Continued)

(56) References Cited

U.S. PATENT DOCUMENTS 5,110,301 A * 5/1992 Inoue ..... H01R 13/62944 403/322.1
5,489,224 A * 2/1996 Schwarz ..... H01R 13/4362 439/466
5,496,186 A 3/1996 Dobbelaere et al.
(Continued)

FOREIGN PATENT DOCUMENTS

WO 2007/018878 A2 2/2007

*Primary Examiner* — Ross Gushi
(74) *Attorney, Agent, or Firm* — Robert J. Myers

(57) ABSTRACT

A connector includes a first-housing, a second-housing, a shroud, and a stacked-gear. The stacked-gear is moveably mounted to the first-housing. The stacked-gear engages a first-gear-rack on the second-housing and a second-gear-rack on the shroud. The second-housing is mated with the first-housing when the shroud is moved along a mating-axis of the connector. The stacked-gear engages at least two teeth on the first-gear-rack and on the second-gear-rack when the second-housing is mated with the first-housing. A rotation of the stacked-gear is greater than ninety degrees when the shroud is moved from an unmated-position to a mated-position. The stacked-gear initially engages a first-side of a first-tooth of the first-gear-rack when the first-housing receives the second-housing. A uniform mating-force is maintained as the shroud is moved from an unmated-position to a mated-position. A mechanical advantage to produce the mating-force is increased as the shroud is moved from an unmated-position to a mated-position.

8 Claims, 10 Drawing Sheets

(58) Field of Classification Search
CPC ..... H01R 13/6295; H01R 13/62955; H01R 13/62961; H01R 13/62966; H01R 13/629
See application file for complete search history.

(56) References Cited

U.S. PATENT DOCUMENTS

| | | | | |
|---|---|---|---|---|
| 6,375,481 | B2 | 4/2002 | Zweigle | |
| 6,390,835 | B1 * | 5/2002 | Okabe | H01R 13/62933 439/157 |
| 6,997,725 | B2 * | 2/2006 | Stella | H01R 13/453 439/157 |
| 7,241,155 | B2 * | 7/2007 | Tyler | H01R 13/62938 439/157 |
| 7,462,047 | B2 * | 12/2008 | Tyler | H01R 13/62938 439/157 |
| 7,695,296 | B1 * | 4/2010 | Hitchcock | H01R 13/62922 439/157 |
| 7,744,390 | B2 * | 6/2010 | Tyler | H01R 13/62977 439/157 |
| 8,356,999 | B2 * | 1/2013 | Imai | H01R 13/62944 439/157 |
| 8,747,130 | B2 * | 6/2014 | Tyler | H01R 13/62977 439/157 |
| 9,312,636 | B2 * | 4/2016 | Wisneski | H01R 13/631 |
| 9,780,487 | B1 * | 10/2017 | Campbell | H01R 13/62916 |
| 9,912,101 | B1 * | 3/2018 | Campbell | H01R 13/62916 |
| 9,917,402 | B1 * | 3/2018 | Campbell | H01R 13/62911 |

* cited by examiner

CONNECTOR ASSEMBLY WITH VARIABLE AXIAL ASSIST

TECHNICAL FIELD OF INVENTION

This disclosure generally relates to a connector, and more particularly relates to an electrical connector assembly with a mate-assist device.

BACKGROUND OF INVENTION

It is known to use mate-assist features on electrical connectors used in automotive applications, especially where a higher number of input/output (I/O) connections per system are required due to increased electrical content on the vehicle. Connectors utilizing an integral lever mechanism typically require pre-positioning of the connector prior to closing the lever assist mechanism. This multi-step mating process is cumbersome for assemblers, as these connection systems are not ergonomically friendly and are also prone to mating damage and/or mis-mating. Additionally, because these systems require tools and/or lever motion during mating, additional application package space is required reducing the total number of terminals possible in the connector.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

SUMMARY OF THE INVENTION

As described herein, the problem of high mate-assist system friction and the reduction of the peak mating-force with a variable mechanical advantage is solved by an axial mate-assist system that utilizes an involute curved non-circular gear with a variable pitch-radius. The variable-pitch-radius gear is configured to provide high mechanical advantage when the connection system components are experiencing their highest mating-forces. This variation of pitch-radius reduces the peak mating-force while providing sufficient total work to fully mate or unmate the connection system.

In accordance with one embodiment, a connector is provided. The connector includes a first-housing, a second-housing, a shroud, and a stacked-gear. The first-housing defines a guide-slot. The second-housing is configured to mate with the first-housing. The second-housing includes a linear-gear-rack extending from a second-outer-surface and configured to engage the guide-slot. The shroud is moveable from an unmated-position to a mated-position. The shroud is longitudinally slideably mounted to and surrounding at least a portion of the first-housing. The shroud also includes a curved-gear-rack having a variable-pitch-radius. The stacked-gear is moveably mounted to the first-housing. The stacked-gear has a round-gear and a cam-gear having the variable-pitch-radius in communication with the round-gear. The round-gear engages the linear-gear-rack within the guide-slot. The cam-gear engages the curved-gear-rack such that the cam-gear moves in response to a movement of the shroud from the unmated-position to the mated-position. Rotation of the round-gear engaged with the linear-gear-rack axially pulls the linear-gear-rack into the guide-slot, thereby pulling the second-housing into the first-housing.

In another embodiment a connector is provided. The connector includes a first-housing, a second-housing, a shroud, and a stacked-gear. The stacked-gear is moveably mounted to the first-housing. The stacked-gear has a round-gear and a cam-gear overlying the round-gear. The round-gear engages a first-gear-rack on the second-housing. The cam-gear engages a second-gear-rack on the shroud, wherein the second-housing is mated with the first-housing when the shroud is moved along a mating-axis of the connector.

Further features and advantages will appear more clearly on a reading of the following detailed description of the preferred embodiment, which is given by way of non-limiting example only and with reference to the accompanying drawings.

BRIEF DESCRIPTION OF DRAWINGS

The present invention will now be described, by way of example with reference to the accompanying drawings, in which.

The reference numbers of similar elements in the various embodiments shown in the figures share the last two digits.

DETAILED DESCRIPTION

Figure 1:
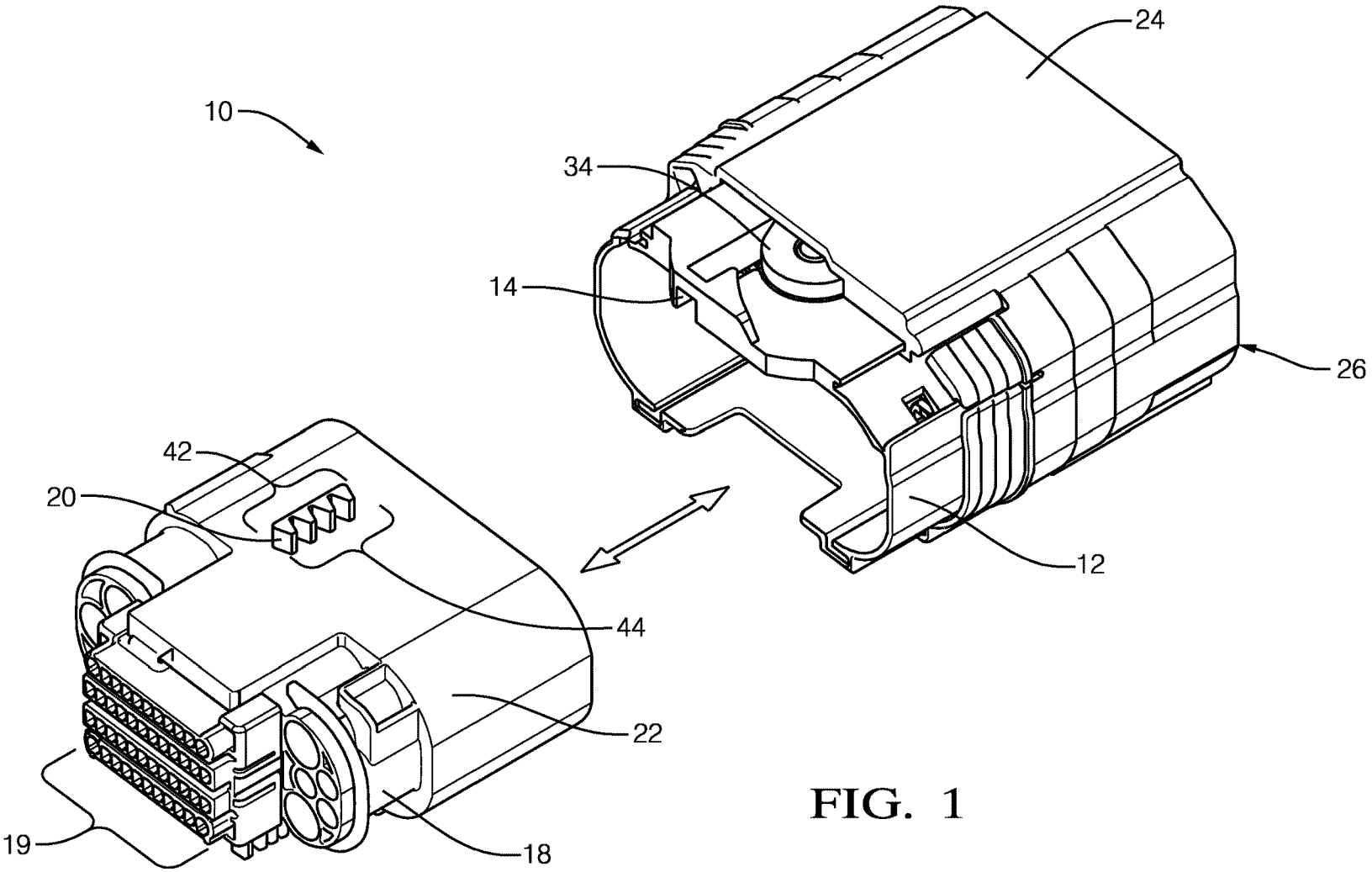
FIG. 1 is an illustration of a connector with a variable axial assist feature in an unmated-position in accordance with one embodiment.

FIG. 1 illustrates a non-limiting example of a connector 10, that includes a first-housing 12 defining a guide-slot 14.

The first-housing 12 may have multiple electrical terminals 16 (not shown) attached to a wire-bundle (not shown) that is a component of a wire-harness or other electrical-components. The first-housing 12 may also include wire seals and strain relief for the wires (not shown).

The connector 10 also includes a second-housing 18 configured to mate with the first-housing 12. The second-housing 18 may also have multiple corresponding mating electrical terminals 19 configured to mate with the electrical terminals 16 of the first-housing 12 attached to a wire-bundle that is a component of a wire-harness or other electrical-components (not shown). The second-housing 18 may also include wire seals and strain relief for the wires, and a perimeter seal (not shown) to form a seal with the first-housing 12. The second-housing 18 includes a linear-gear-rack 20 extending from a second-outer-surface 22 and configured to engage the guide-slot 14.

Figure 2B:
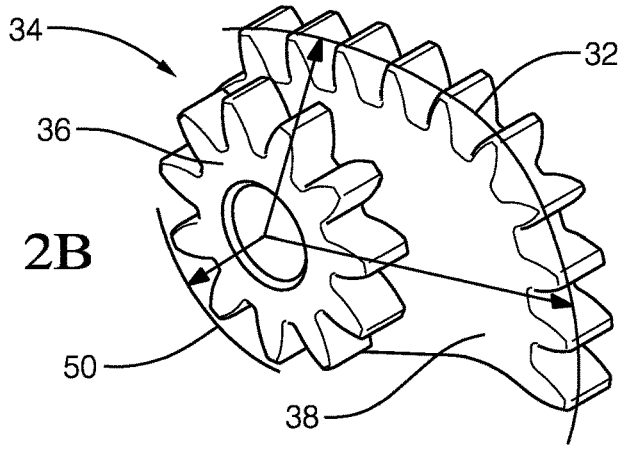
FIG. 2B is a detail view of a stacked-gear of the connector of FIG. 2A in accordance with one embodiment.
Figure 2A:
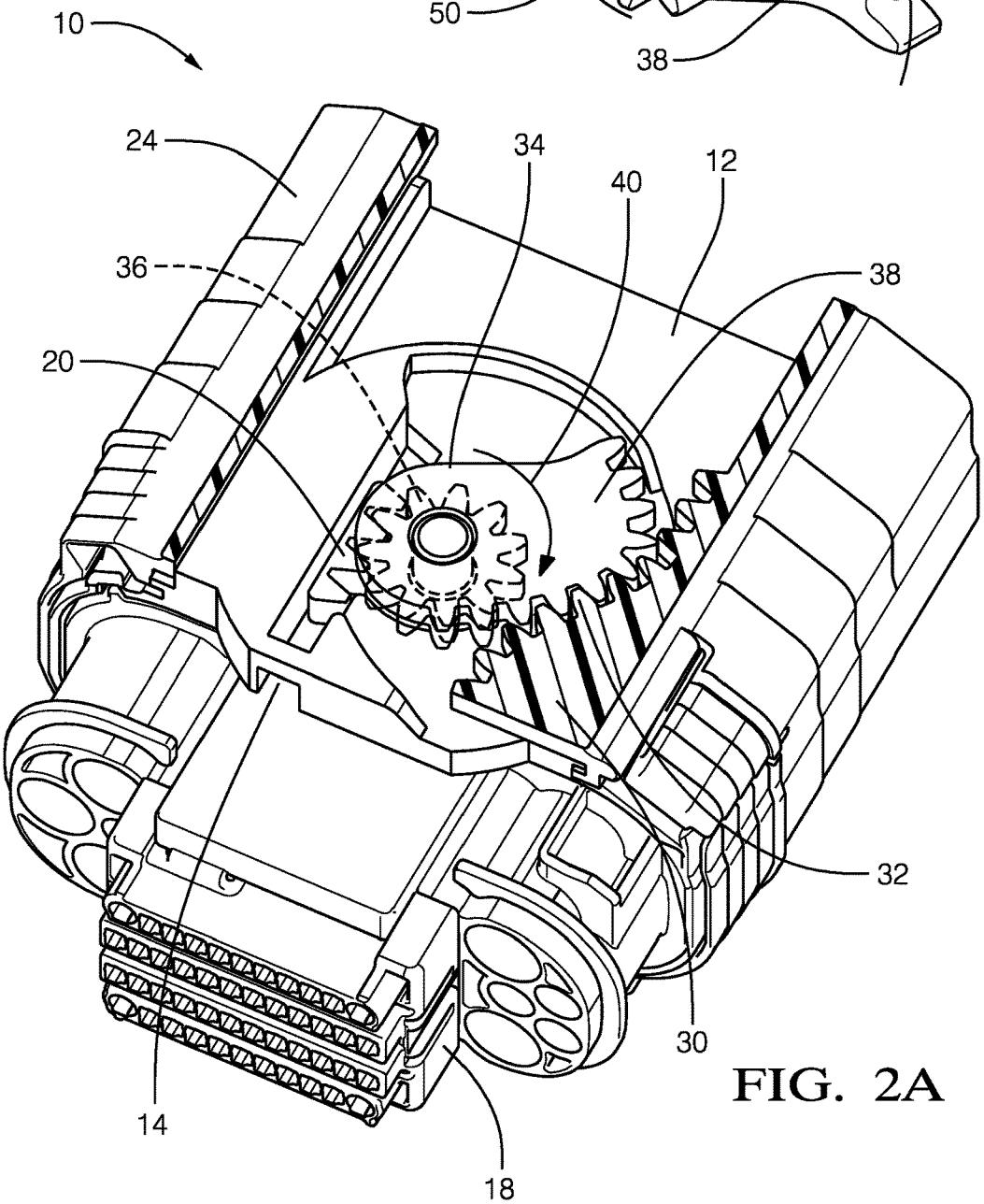
FIG. 2A is a section view of the connector of FIG. 1 in accordance with one embodiment.
Figure 3:
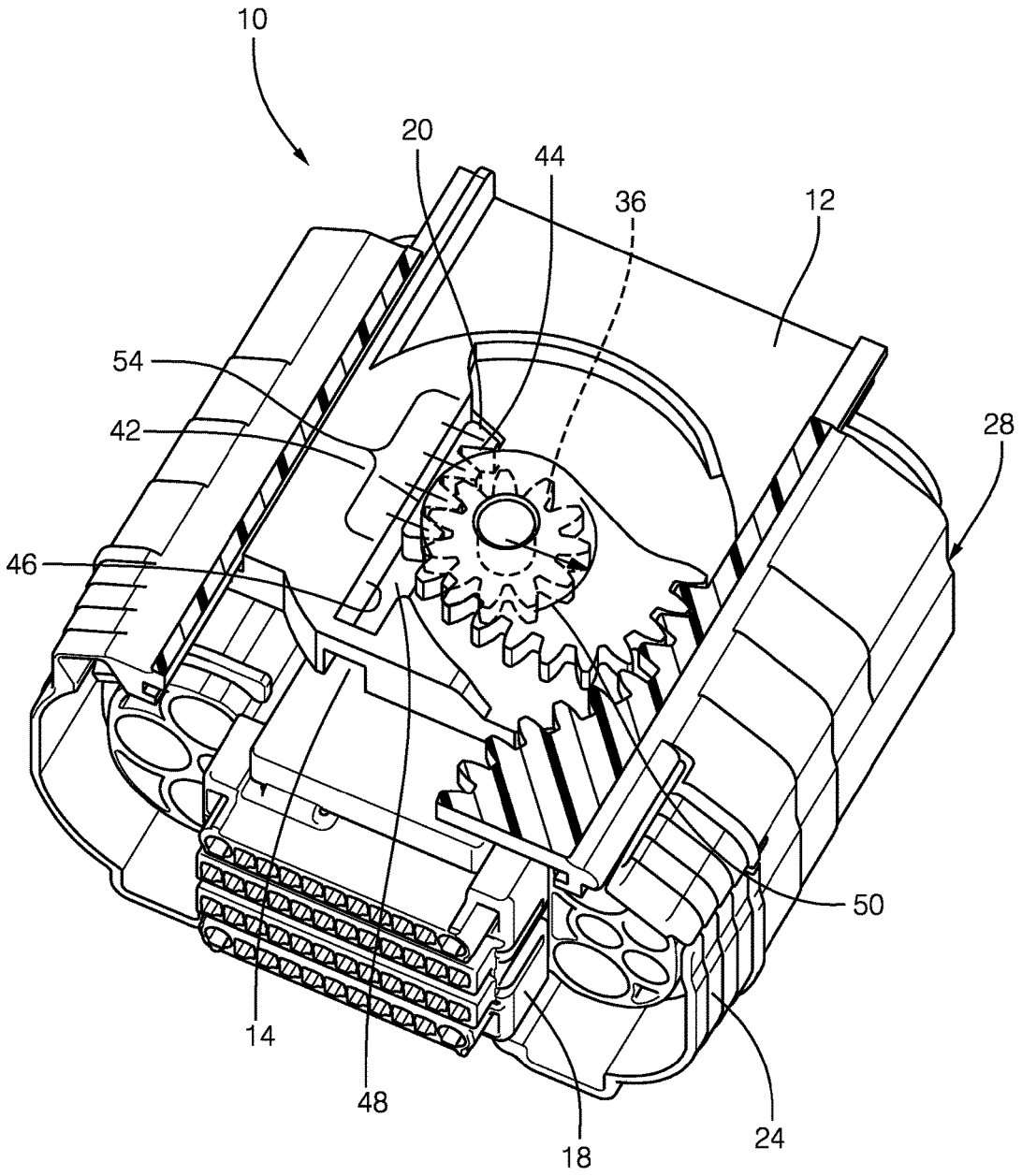
FIG. 3 is a section view of the connector of FIG. 1 in a mated-position in accordance with one embodiment.

The connector 10 also includes a shroud 24 moveable from an unmated-position 26 to a mated-position 28 (see FIG. 3). The shroud 24 is longitudinally slideably mounted to and surrounding at least a portion of the first-housing 12, and includes a curved-gear-rack 30 having a variable-pitch-radius 32 (see FIG. 2A).

The connector 10 also includes a stacked-gear 34 rotatably mounted to the first-housing 12. The stacked-gear 34 has a round-gear 36 and a cam-gear 38 having the variable-pitch-radius 32 in communication with the round-gear 36 (see FIG. 2B). The round-gear 36 engages the linear-gear-rack 20 within the guide-slot 14, and the cam-gear 38 simultaneously engages the curved-gear-rack 30 such that the cam-gear 38 moves in response to a movement of the shroud 24 from the unmated-position 26 to the mated-position 28. The movement of the shroud 24 causes a rotation 40 of the round-gear 36 that is engaged with the linear-gear-rack 20, and axially pulls the linear-gear-rack 20 into the guide-slot 14, thereby pulling the second-housing 18 into the first-housing 12 (see FIG. 2A).

As illustrated in FIG. 3, the linear-gear-rack 20 defines a guide-side 42 and a tooth-side 44, and the guide-slot 14 defines a guide-wall 46 and an aperture 48. The guide-side 42 slideably engages the guide-wall 46 and the tooth-side 44 is disposed within the aperture 48 to engage a portion of the round-gear 36 that is also disposed within the aperture 48. The round-gear 36 has a constant-pitch-radius 50 (i.e. all teeth have equal pitch-radii 52) and the linear-gear-rack 20 has a consistent pitch-spacing 54. In alternative embodiments, the round-gear 36 and the corresponding linear-gear-rack 20 may be replaced by gears having other geometries that may include variable-pitch-radii 32 to meet the requirements of the application.

Figure 4:
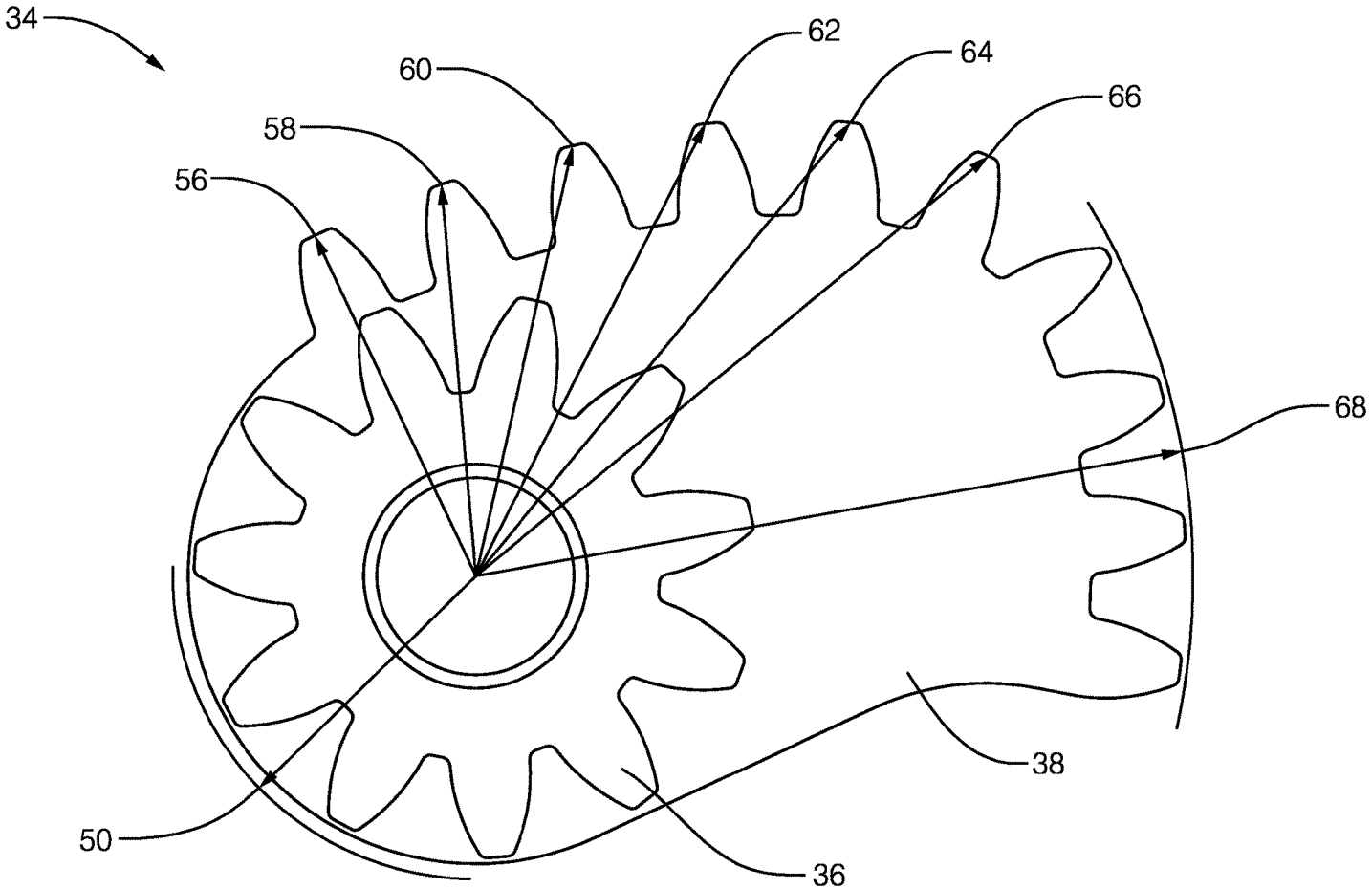
FIG. 4 is an illustration of the stacked-gear of the connector of FIG. 1 with a variable-pitch-radius in accordance with one embodiment.

FIG. 4 illustrates a non-limiting example of the stacked-gear 34 wherein the cam-gear 38 and the curved-gear-rack 30 (not shown) have a first-pitch-radius 56 equivalent to 1.4 times the pitch-radius 52 of the round-gear 36 (i.e. the constant-pitch-radius 50). Table 1 below lists the pitch-radii 52 of the cam-gear 38 as a multiple of the pitch-radius 52 of the round-gear 36 for the seven unique pitch-radii 52 illustrated in FIG. 4. While the curved-gear-rack 30 is not shown in FIG. 4, it will be understood that the values of the pitch-radii 52 of the cam-gear 38 will be the same for the curved-gear-rack 30 illustrated in FIG. 2A. The pitch-radii 52 of the cam-gear 38 are designed such that a uniform mating-force (as experienced by an operator of the connector 10) of 50 Newtons (50N) may be maintained throughout the mating sequence of the connector 10. This mating-force may be adjusted by changing the pitch-radii 52 of the cam-gear 38 and/or the round-gear 36 to meet the ergonomic requirements of the operator.

TABLE 1

| CAM-GEAR 38 AND CURVED-GEAR-RACK 30 PITCH-RADII 52 | MULTIPLE OF THE ROUND-GEAR 36 PITCH-RADIUS 52 |
|---|---|
| FIRST-PITCH-RADIUS 56 | 1.40 |
| SECOND-PITCH-RADIUS 58 | 1.49 |
| THIRD-PITCH-RADIUS 60 | 1.73 |
| FOURTH-PITCH-RADIUS 62 | 2.01 |
| FIFTH-PITCH-RADIUS 64 | 2.33 |
| SIXTH-PITCH-RADIUS 66 | 2.60 |
| SEVENTH-PITCH-RADIUS 68 | 2.74 |

Figure 5C:
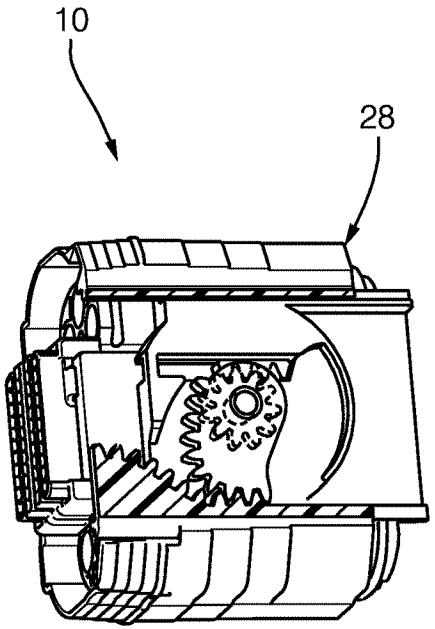
FIG. 5C is a section view of the connector of FIG. 1 in the mated-position in accordance with one embodiment.
Figure 5B:
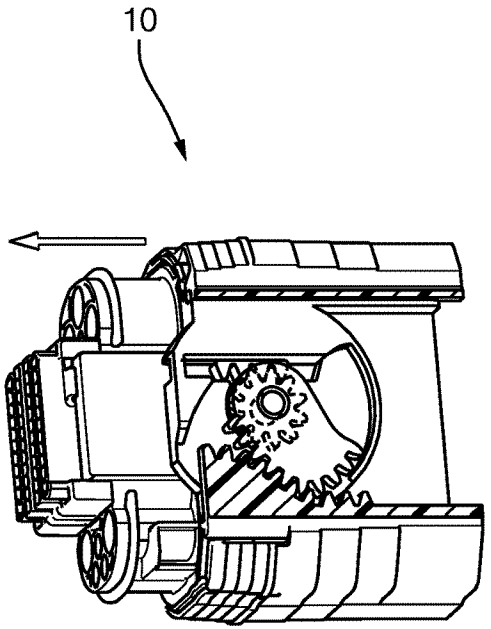
FIG. 5B is a section view of the connector of FIG. 1 in an intermediate position in accordance with one embodiment.
Figure 5A:
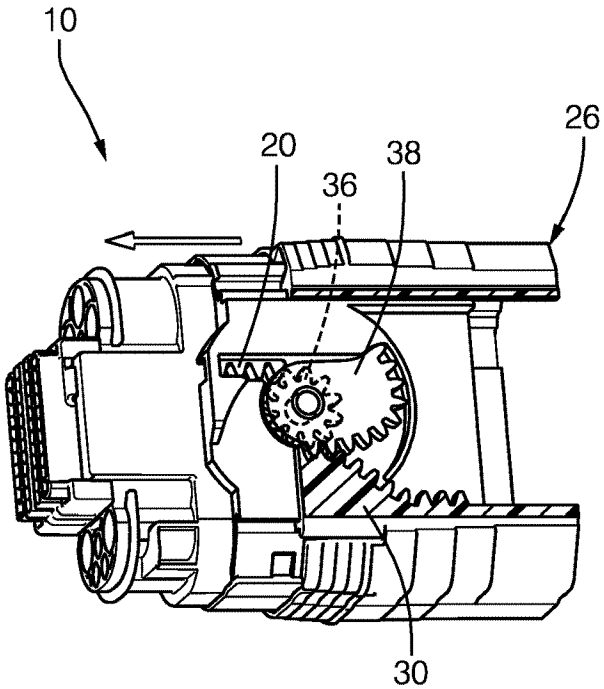
FIG. 5A is a section view of the connector of FIG. 1 in the unmated-position in accordance with one embodiment.

FIGS. 5A-5C illustrate the progression of the mating sequence of the connector 10 from a point where the linear-gear-rack 20 first engages the round-gear 36 with the shroud 24 in the unmated-position 26 (see FIG. 5A), to an intermediate position (see FIG. 5B), and to the point where the shroud 24 is moved to the mated-position 28 (see FIG. 5C). In FIG. 5A, the engagement of the smaller pitch-radius 52 of the cam-gear 38 exhibits a smaller mechanical advantage compared to the engagement of the larger pitch-radii 52 illustrated in FIGS. 5B-5C. This increase in the mechanical advantage is advantageous to the operator, as a larger mating-force is required to mate the electrical terminals 16 as the mating sequence progresses.

Figure 6:
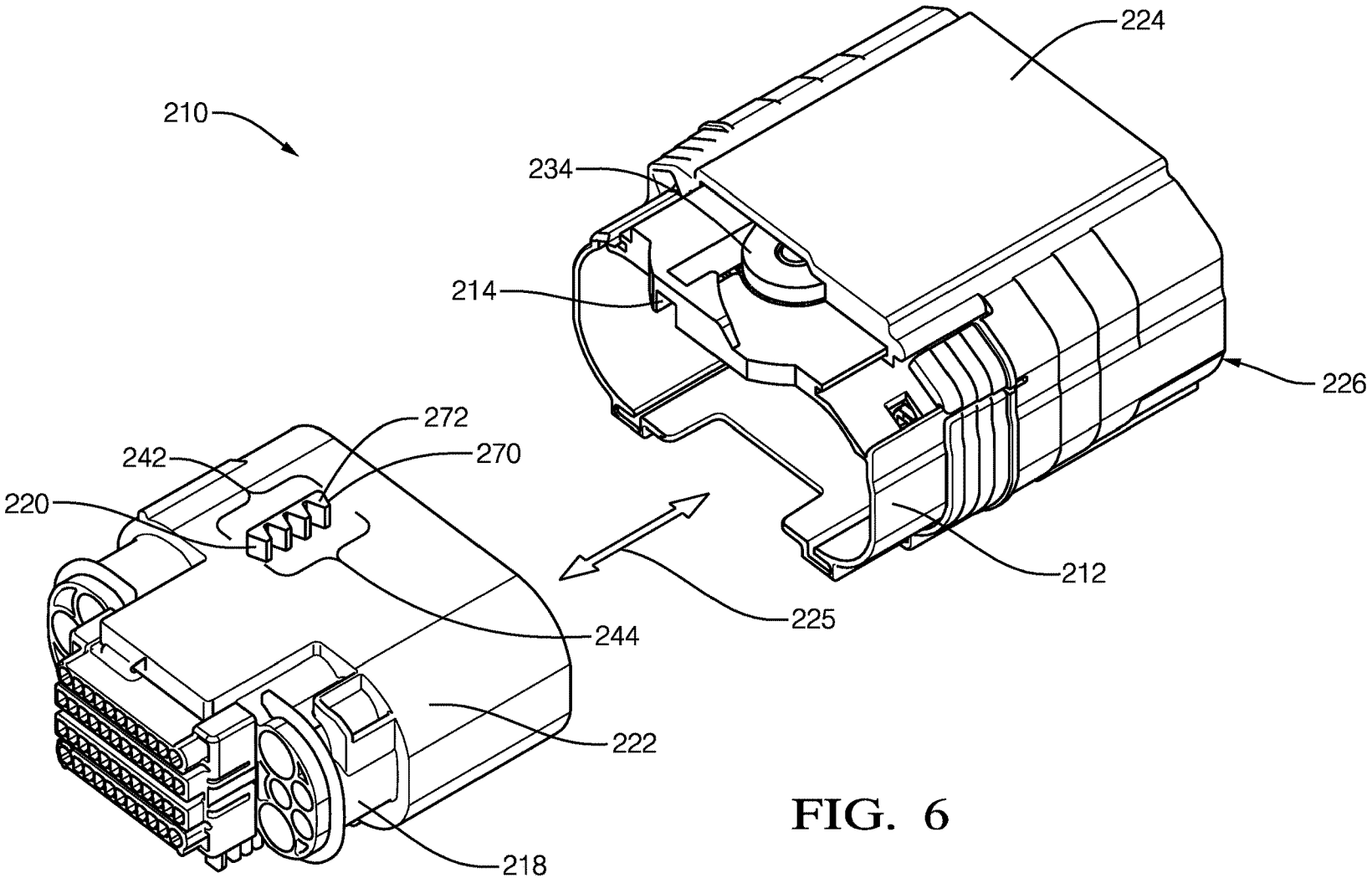
FIG. 6 is an illustration of a connector with a variable axial assist feature in an unmated-position in accordance with another embodiment.

FIG. 6 illustrates yet another embodiment of a non-limiting example of a connector 210 that includes a first-housing 212 defining a guide-slot 214. The first-housing 212 may have multiple electrical terminals 216 (not shown) attached to a wire-bundle (not shown) that is a component of a wire-harness or other electrical-components. The first-housing 212 may also include wire seals and strain relief for the wires (not shown).

The connector 210 also includes a second-housing 218 configured to mate with the first-housing 212. The second-housing 218 may also have multiple corresponding electrical terminals 216 (not shown) configured to mate with the electrical terminals 216 of the first-housing 212 attached to a wire-bundle that is a component of a wire-harness or other electrical-components (not shown). The second-housing 218 may also include wire seals and strain relief for the wires, and a perimeter seal (not shown) to form a seal with the first-housing 212. The second-housing 218 includes a first-gear-rack 220 extending from a second-outer-surface 222 and configured to engage the guide-slot 214.

Figure 7B:
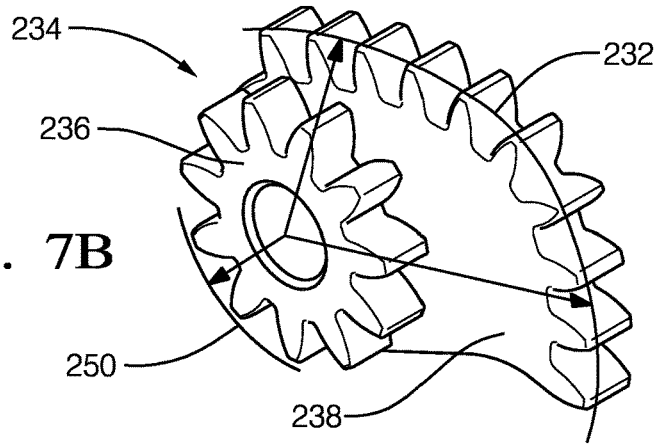
FIG. 7B is an illustration of a stacked-gear of the connector of FIG. 7A in accordance with another embodiment.
Figure 7A:
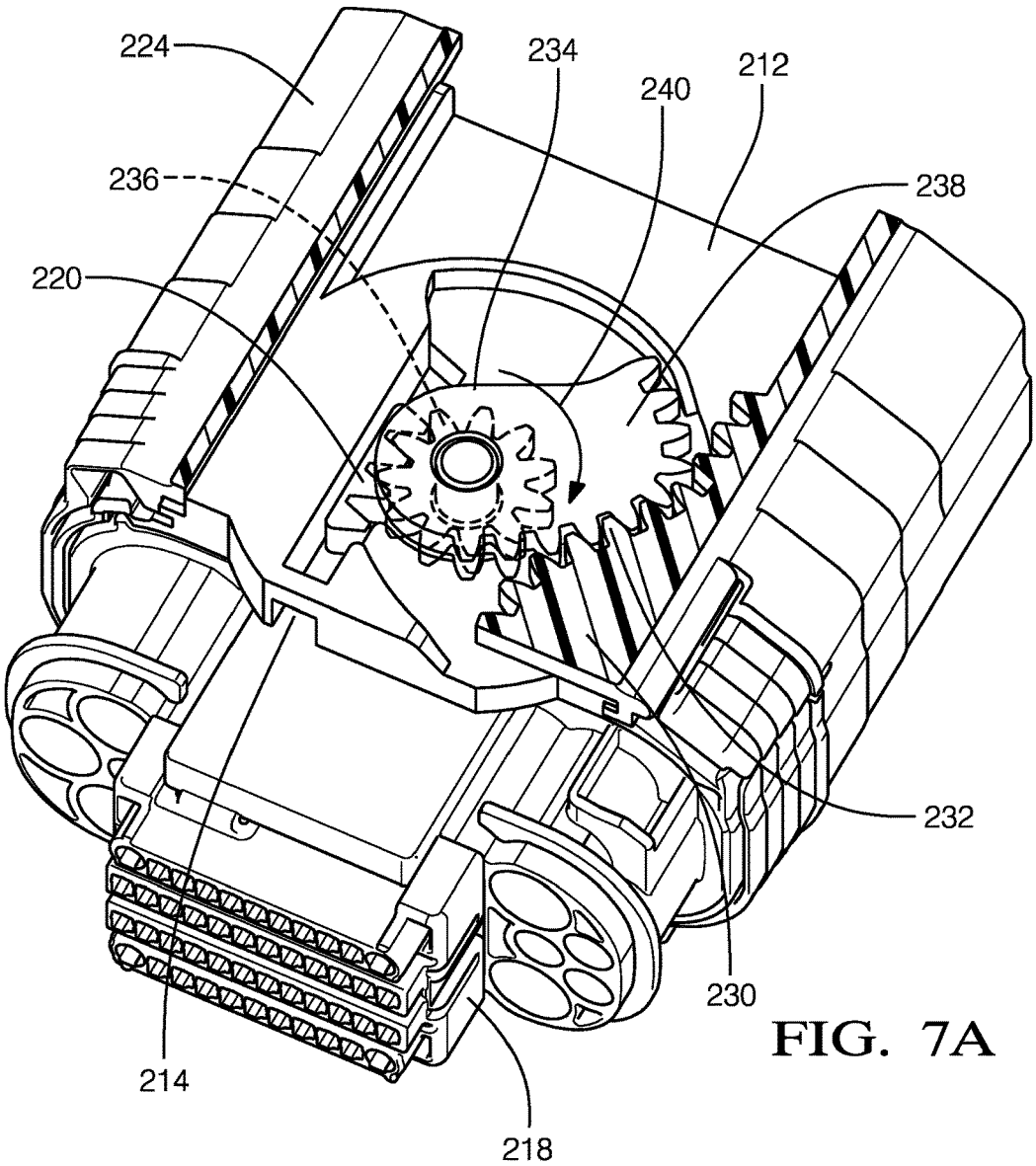
FIG. 7A is a section view of the connector of FIG. 6 in accordance with another embodiment.
Figure 8:
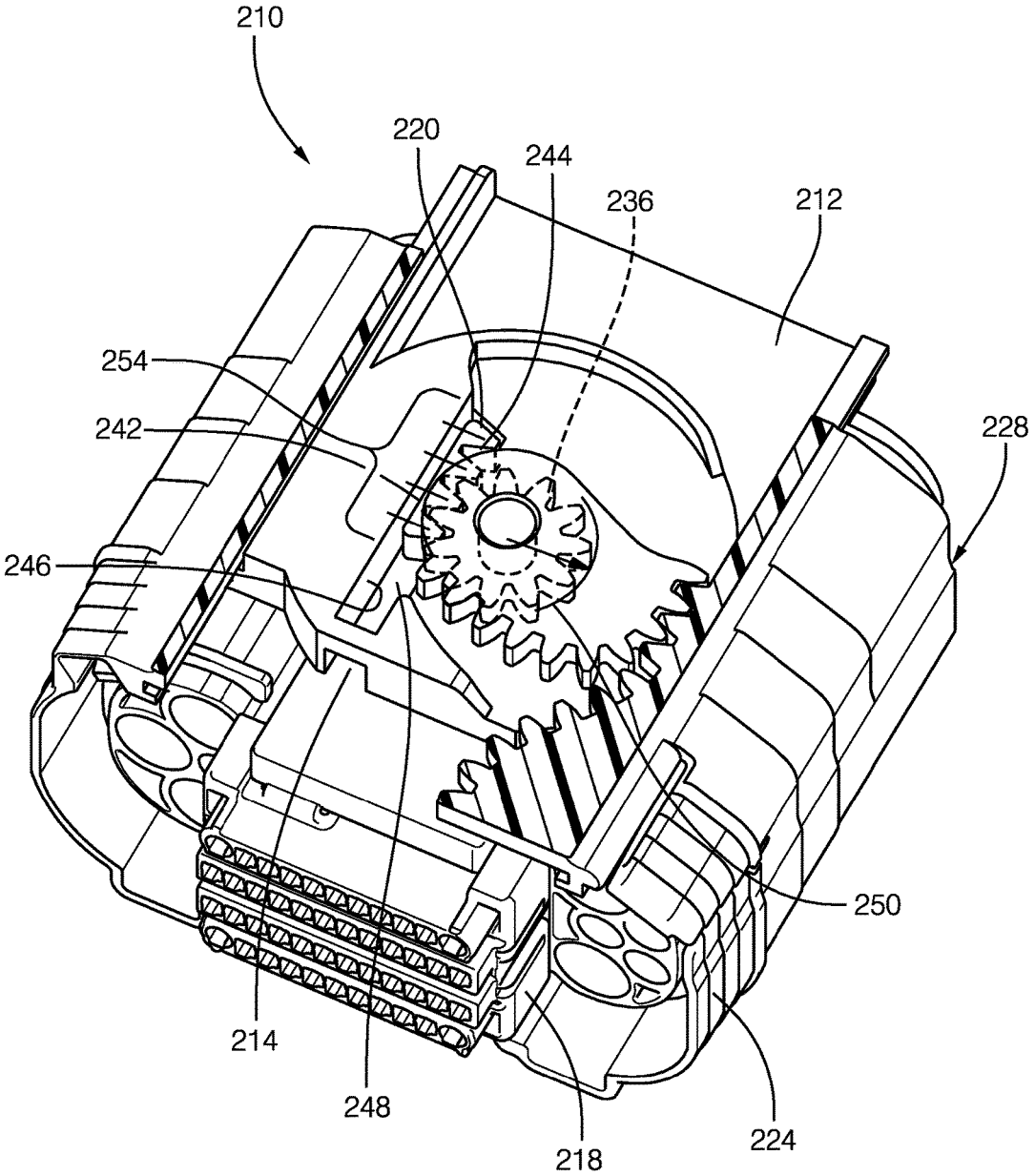
FIG. 8 is a section view of the connector of FIG. 6 in a mated-position in accordance with another embodiment.

The connector 210 also includes a shroud 224 moveable from an unmated-position 226 to a mated-position 228 (see FIG. 8). The shroud 224 is longitudinally slideably mounted to and surrounding at least a portion of the first-housing 212, and includes a second-gear-rack 230 having a variable-pitch-radius 232 (see FIGS. 7A-7B).

The connector 210 also includes a stacked-gear 234 rotatably mounted to the first-housing 212. The stacked-gear 234 has a round-gear 236 and a cam-gear 238 overlying the round-gear 236 (see FIG. 7B). The cam-gear 238 has the variable-pitch-radius 232 (see FIG. 7B). The round-gear 236 engages the first-gear-rack 220 on the second-housing 218, and the cam-gear 238 simultaneously engages the second-gear-rack 230 on the shroud 224. The second-housing 218 is mated with the first-housing 212 when the shroud 224 is moved along a mating-axis 225 of the connector 210.

As illustrated in FIG. 8, the round-gear 236 engages the first-gear-rack 220 within the guide-slot 214, and the cam-gear 238 simultaneously engages the second-gear-rack 230 such that the cam-gear 238 moves in response to a movement of the shroud 224 from the unmated-position 226 to the mated-position 228. The movement of the shroud 224 along the mating-axis 225 causes a rotation 240 of the round-gear 236 that is engaged with the first-gear-rack 220, and axially pulls the first-gear-rack 220 into the guide-slot 214, thereby pulling the second-housing 218 into the first-housing 212.

As illustrated in FIG. 8, the first-gear-rack 220 defines a guide-side 242 and a tooth-side 244, and the guide-slot 214 defines a guide-wall 246 and an aperture 248. The guide-side 242 slideably engages the guide-wall 246 and the tooth-side 244 is disposed within the aperture 248 to engage a portion of the round-gear 236 that is also disposed within the aperture 248. The round-gear 236 has a constant-pitch-radius 250 (i.e. all teeth have equal pitch-radii 252) and the first-gear-rack 220 has a consistent pitch-spacing 254. In alternative embodiments, the round-gear 236 and the corresponding first-gear-rack 220 may be replaced by gears having other geometries that may include variable-pitch-radii 232 to meet the requirements of the application.

Figure 9:
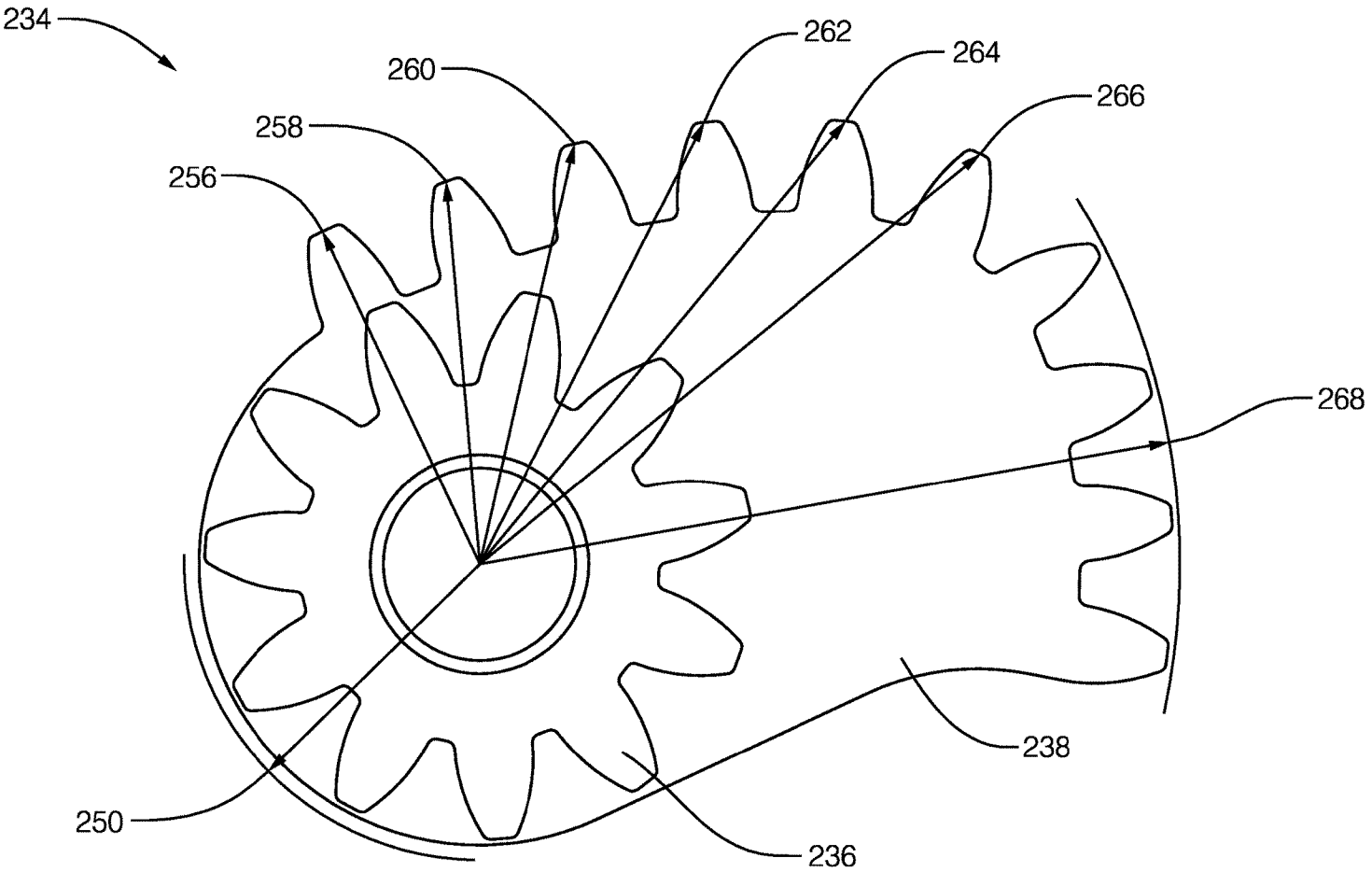
FIG. 9 is an illustration of the stacked-gear of the connector of FIG. 6 with a variable-pitch-radius in accordance with another embodiment.

FIG. 9 illustrates a non-limiting example of the stacked-gear 234, wherein the cam-gear 238 and the second-gear-rack 230 (not shown) have a first-pitch-radius 256 equivalent to 1.4 times the pitch-radius 252 of the round-gear 236. Table 2 below lists the pitch-radii 252 of the cam-gear 238 as a multiple of the pitch-radius 252 of the round-gear 236 for the seven unique pitch-radii 252 illustrated in FIG. 9. While the second-gear-rack 230 is not shown in FIG. 9, it will be understood that the values of the pitch-radii 252 of the cam-gear 238 are the same for the second-gear-rack 230 illustrated in FIG. 7A. The pitch-radii 252 of the cam-gear 238 are designed such that a uniform mating-force (as experienced by an operator of the connector 210) of 50 Newtons (50N) may be maintained throughout the mating sequence of the connector 210. This mating-force may be adjusted by changing the pitch-radii 252 of the cam-gear 238 and/or the round-gear 236 to meet the ergonomic requirements of the operator.

TABLE 2

| CAM-GEAR 238 AND SECOND-GEAR-RACK 230 PITCH-RADII 252 | MULTIPLE OF THE ROUND-GEAR 236 PITCH-RADIUS 252 |
|---|---|
| FIRST-PITCH-RADIUS 256 | 1.40 |
| SECOND-PITCH-RADIUS 258 | 1.49 |
| THIRD-PITCH-RADIUS 260 | 1.73 |
| FOURTH-PITCH-RADIUS 262 | 2.01 |
| FIFTH-PITCH-RADIUS 264 | 2.33 |
| SIXTH-PITCH-RADIUS 266 | 2.60 |
| SEVENTH-PITCH-RADIUS 268 | 2.74 |

Figure 10C:
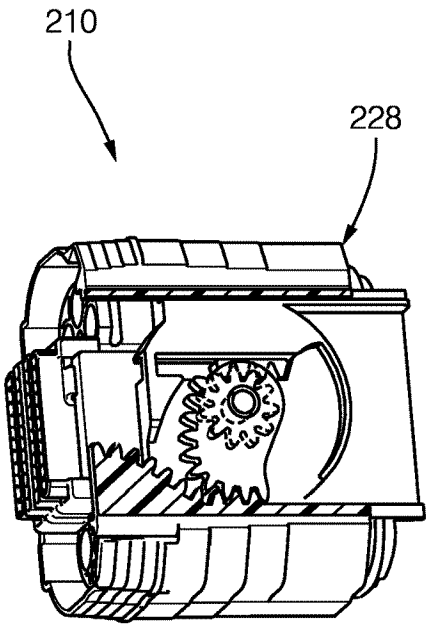
FIG. 10C is a section view of the connector of FIG. 6 in the mated-position in accordance with another embodiment.
Figure 10B:
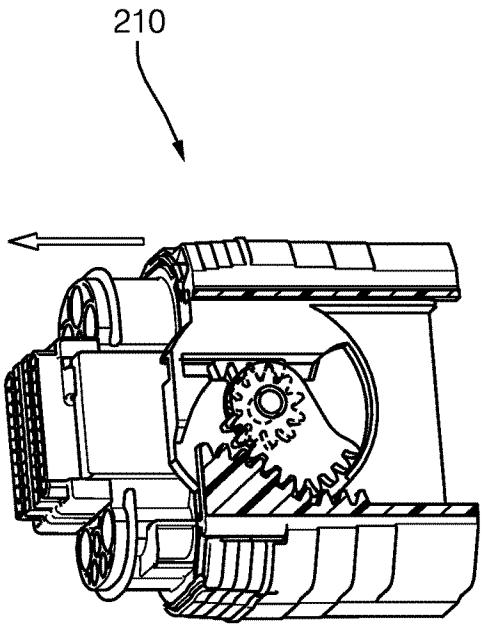
FIG. 10B is a section view of the connector of FIG. 6 in an intermediate position in accordance with another embodiment.
Figure 10A:
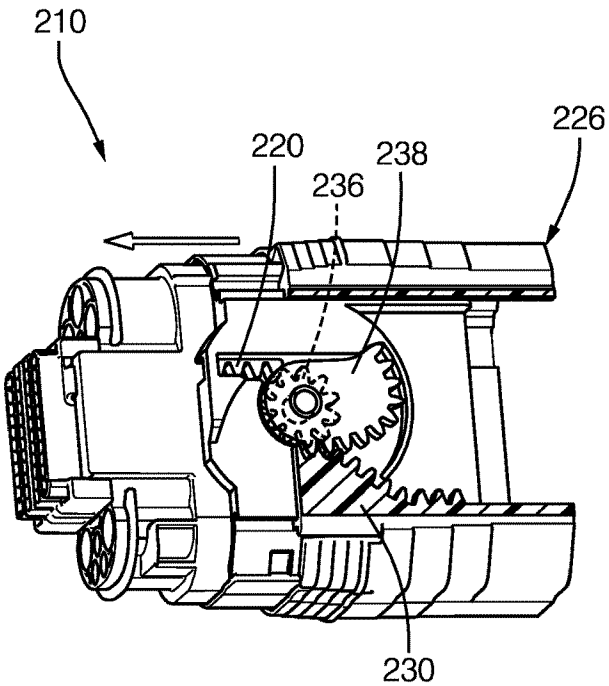
FIG. 10A is a section view of the connector of FIG. 6 in the unmated-position in accordance with another embodiment.

FIGS. 10A-10C illustrate the progression of the mating sequence of the connector 210 from a point where the first-gear-rack 220 first engages the round-gear 236 with the shroud 224 in the unmated-position 226 (see FIG. 10A), to an intermediate position (see FIG. 10B), and to the point where the shroud 224 is moved to the mated-position 228 (see FIG. 10C). FIGS. 10A-10C also illustrate that the rotation 240 of the stacked-gear 234 is greater than ninety degrees when the shroud 224 is moved from the unmated-position 226 to the mated-position 228. In FIG. 10A, the engagement of the smaller pitch-radius 252 of the cam-gear 238 exhibits a smaller mechanical advantage compared to the engagement of the larger pitch-radii 252 illustrated in FIGS. 10B-10C. This increase in the mechanical advantage is advantageous to the operator, as a larger mating-force is required to mate the electrical terminals 216 as the mating sequence progresses. FIG. 10A also illustrates that the stacked-gear 234 initially engages a first-side 270 of a first-tooth 272 (see FIG. 6) of the first-gear-rack 220 when the first-housing 212 receives the second-housing 218. FIG. 10C illustrates that the stacked-gear 234 engages at least two teeth on the first-gear-rack 220 and on the second-gear-rack 230 when the second-housing 218 is mated with the first-housing 212.

The examples presented herein are directed to electrical connectors 10. However, other embodiments of the connector 10 may be envisioned that are adapted for use with optical cables or hybrid connections including both electrical and optical cables. Yet other embodiments of the connector 10 may be envisioned that are configured for connecting pneumatic or hydraulic lines.

Accordingly, a connector 10 that includes a variable axial assist feature is provided. The connector 10 is an improvement over prior-art-connectors because the mechanical advantage varies as the mating sequence progresses, such that the operator applies a constant mating-force.

While this invention has been described in terms of the preferred embodiments thereof, it is not intended to be so limited, but rather only to the extent set forth in the claims that follow. Moreover, the use of the terms first, second, etc. does not denote any order of importance, but rather the terms first, second, etc. are used to distinguish one element from another. Furthermore, the use of the terms a, an, etc. do not denote a limitation of quantity, but rather denote the presence of at least one of the referenced items. Additionally, directional terms such as upper, lower, etc. do not denote any particular orientation, but rather the terms upper, lower, etc. are used to distinguish one element from another and locational establish a relationship between the various elements.

We claim:

1. A connector, comprising:
a first-housing;
a second-housing;
a shroud; and
a stacked-gear moveably mounted to the first-housing, said stacked-gear engaging a first-gear-rack on the second-housing and a second-gear-rack on the shroud, wherein the second-housing is mated with the first-housing when the shroud is moved along a mating-axis of the connector.

2. The connector in accordance with claim 1, wherein the stacked-gear engages at least two teeth on the first-gear-rack when the second-housing is mated with the first-housing.

3. The connector in accordance with claim 1, wherein the stacked-gear engages at least two teeth on the second-gear-rack when the second-housing is mated with the first-housing.

4. The connector in accordance with claim 1, wherein a rotation of the stacked-gear is greater than ninety degrees when the shroud is moved from an unmated-position to a mated-position.

5. The connector in accordance with claim 1, wherein the stacked-gear initially engages a first-side of a first-tooth of the first-gear-rack when the first-housing receives the second-housing.

6. The connector in accordance with claim 1, wherein a uniform mating-force is maintained as the shroud is moved from an unmated-position to a mated-position.

7. The connector in accordance with claim 6, wherein the uniform mating-force is 50 Newtons.

8. The connector in accordance with claim 6, wherein a mechanical advantage to produce the uniform mating-force is increased as the shroud is moved from the unmated-position to the mated-position.

* * * * *